US008726707B1

(12) United States Patent
Burpee

(10) Patent No.: US 8,726,707 B1
(45) Date of Patent: May 20, 2014

(54) LAUNDRY COIN ANTI-THEFT DEVICE

(71) Applicant: John Burpee, Seminole, FL (US)

(72) Inventor: John Burpee, Seminole, FL (US)

( * ) Notice: Subject to any disclaimer, the term of this patent is extended or adjusted under 35 U.S.C. 154(b) by 0 days.

(21) Appl. No.: 13/760,120

(22) Filed: Feb. 6, 2013

(51) Int. Cl.
*E05B 15/16* (2006.01)

(52) U.S. Cl.
USPC ..... 70/417; 70/56; 70/164

(58) Field of Classification Search
USPC ..... 70/2, 56, 158, 163, 164, 416, 417, 423, 70/424, 426, 428, 439, 455
See application file for complete search history.

(56) References Cited

U.S. PATENT DOCUMENTS 4,191,034 A * 3/1980 Froess et al. ..... 70/258
4,302,137 A 11/1981 Hart
4,370,873 A * 2/1983 Edmunds ..... 70/163
4,406,358 A 9/1983 Zahradnik
4,619,122 A 10/1986 Simpson
4,637,234 A 1/1987 Mielonen
4,655,060 A 4/1987 Jakubas
4,873,851 A * 10/1989 Arnett ..... 70/259
5,018,920 A 5/1991 Speakman
6,030,161 A 2/2000 Udell et al.
6,367,292 B1 * 4/2002 Bunger ..... 70/56
6,578,398 B2 6/2003 Behunin
6,755,053 B1 * 6/2004 Dias ..... 70/14
6,953,149 B2 * 10/2005 Taylor ..... 232/45
7,210,316 B1 * 5/2007 Falconer et al. ..... 70/2
2012/0204609 A1 * 8/2012 Sheldahl et al. ..... 70/20

* cited by examiner

*Primary Examiner* — Christopher Boswell
(74) *Attorney, Agent, or Firm* — Larson & Larson, P.A.; Frank Liebenow; Justin P. Miller

(57) ABSTRACT

The laundry coin anti-theft device protects a laundry coin box from damage by brute force attacks, such as by a sledgehammer, or prying, such as from a crowbar. The laundry coin anti-theft device is a pin that crosses the centerline of the laundry coin box lock, blocking access. The laundry coin anti-theft device protects itself by the use of a sleeve, the sleeve making it difficult to cause damage by twisting because the sleeve prevents gripping.

15 Claims, 4 Drawing Sheets

LAUNDRY COIN ANTI-THEFT DEVICE

FIELD

This invention relates to the field of anti-theft devices, particularly for coin storage within laundromats.

BACKGROUND

Laundromats present an appealing target for thieves. Long operational hours and large amounts of cash and coins create an appearance of easy theft. Each machine in a laundromat has an associated coin box for storage of coins, generally quarters. Coin boxes are infrequently opened and can accumulate hundreds of dollars of quarters between changes.

Existing systems for protecting coin boxes are bulky and complicated. A system for protecting a coin box that is itself too costly or complicated is not used, and is thus ineffective.

What is needed is a practical and straightforward device for protecting laundromat coin boxes.

SUMMARY

Coin boxes are most susceptible to brute-force attacks. A crowbar can be inserted between the wall of the coin mechanism housing and the coin box, forcing open the coin box. Or a sledgehammer may be used against the face of the coin box, breaking the coin box lock.

Rather than making expensive modifications to the coin box to attempt to prevent theft, it is more economical and efficient to modify existing coin mechanism housings to block access to the coin box lock, and the coin box itself. If a thief does not have room to insert a crowbar, the coin box cannot be pried open. If a thief cannot hit the face of the coin box lock with a sledgehammer, the lock cannot be broken.

The laundry coin anti-theft device accomplishes both of these goals. It crosses the centerline of the face of the coin box, blocking crowbar access. The laundry coin anti-theft device also prevents the sides of the coin mechanism housing from being pried away from the coin box by coupling the left side to the right side.

Additionally, the lock is protected because if a thief attempts to hit the face of the coin box, he will hit the laundry coin anti-theft device first.

Thus, the pin portion of the laundry coin anti-theft device provides protection to the coin box. But, this makes the pin itself a target for damage. If the pin can be removed, then the coin box is again accessible.

The pin is susceptible to failure by twisting and cutting. If the pin can be gripped in two locations with large wrenches (e.g., pipe wrenches), there may be sufficient twisting force to break the pin. Alternatively, if the pin can be gripped with one wrench and the lock on the pin gripped with a second wrench, it is possible to cause the pin to fail or the lock to fail. Or, if the pin can be gripped and cut with bolt-cutters or sawn, it can be removed.

There are three primary design features of the laundry coin anti-theft device that make these failures unlikely.

The first is a flat, disc-shaped head. The head is thin and round, making it difficult to grasp. There is optionally a chamfered edge or rounded edge on the head, minimizing what little flat surface the circumference of the head provides to grasp.

The second is the sleeve. The sleeve rotates freely on the pin, making it difficult to grip the pin. With the sleeve covering nearly the entire pin there is little room to grasp the portion of the pin in front of the coin box. Thus, the lock remains the only portion that can be grasped, and two or more points of contact are required to apply a twisting force to the pin. As a result, the laundry coin anti-theft device cannot be destroyed by twisting. Nor is a saw effective, because the sleeve rotates with the passing of the saw. The sleeve can be constructed of a very robust material, such as hardened steel, making it impervious to all by the largest bolt cutters.

The third is the room for a larger, more robust lock. The coin box itself does not have room for a large lock, limiting how robust the installed lock can be. In contrast, the laundry coin anti-theft device can accommodate a substantial, robust lock.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
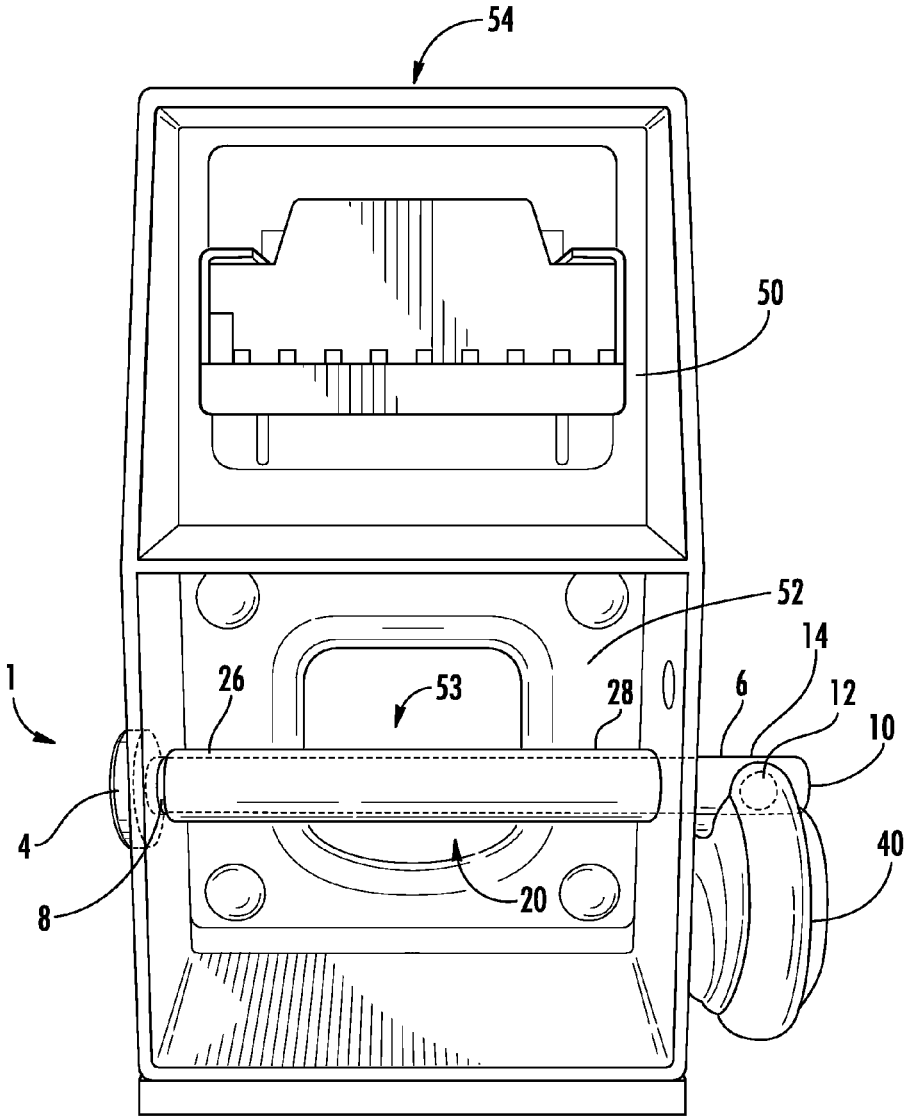
FIG. 1 illustrates a front view of a first embodiment of the laundry coin anti-theft device.

Reference will now be made in detail to the presently preferred embodiments of the invention, examples of which are illustrated in the accompanying drawings. Throughout the following detailed description, the same reference numerals refer to the same elements in all figures.

Referring to FIG. 1, an embodiment of the laundry coin anti-theft device 1 of the present invention is shown. The laundry coin anti-theft device 1 includes a pin 2 (see FIG. 4) that includes a head 4, a rod portion 6, having a proximal end 8 and a distal end 10. The head 4 is adapted for contact with an exterior surface of the coin mechanism housing 54. The head preferably has a substantially circular shape to make gripping it difficult.

The laundry coin mechanism holds 54 houses two components, the coin slide 50 into which a customer inserts coins, and coin box 52, which holds the coins that have been accepted by the coin slide 50. Thieves are more likely to target the coin box 52 that the coin slide 50 because coins only reside within the coin slide 50 during insertion, afterwards falling into the coin box 52. Access to the coin box 52 by way of the coin slide 50 is difficult, requiring more time that a thief is willing to spend on a single machine.

The coin box lock 53 (hidden behind the laundry coin anti-theft device 1) secures the coin box 52 from being opened by curious customers. But the coin box lock 53 is susceptible to being picked, as well as overridden by brute force.

The rod portion 6 is an elongated shaft that is integral to the head 4, extending from the head 4. The head 4 engages the exterior surface of the coin mechanism housing 54 with a contact surface having an area sufficiently large to prevent being pulled through the penetration in the coin mechanism housing 54.

The rod portion 6 is substantially round, preferably with a circular cross-sectional shape. But many other designs and shapes can be used to accomplish the same purpose. For example, a rod of triangular cross-section is equally effective because while the triangular shape results in the pin 6 being more easily gripped, it is still enclosed by the sleeve 20, preventing access to the rod portion 6 of the pin 2.

It is anticipated that the pin be constructed of a robust material, such as steel, to resist crushing force. But any other material is anticipated, including all types of metals and composite materials.

The rod portion 6 of the pin 2 is preferably smooth. A smooth surface reduces friction with the sleeve 20, in turn lowering the resistance between the sleeve 20 and the pin 2, making it difficult to transfer any rotational force from the sleeve 20 to the pin 6.

It is anticipated that the sleeve be constructed of a robust material, such as steel, to resist crushing force. But any other material is anticipated, including all types of metals and composite materials.

The sleeve has a proximal end 26, closest to the head 4 of the pin 2, and distal end 28, closest to the lock penetration 12 and lock 40.

Lock penetration 12 is a hole or other type of attachment point for a lock 40. The lock 40 illustrated is a round padlock, often used in high-security settings because of its robust construction and the limited access to the shank.

Figure 2:
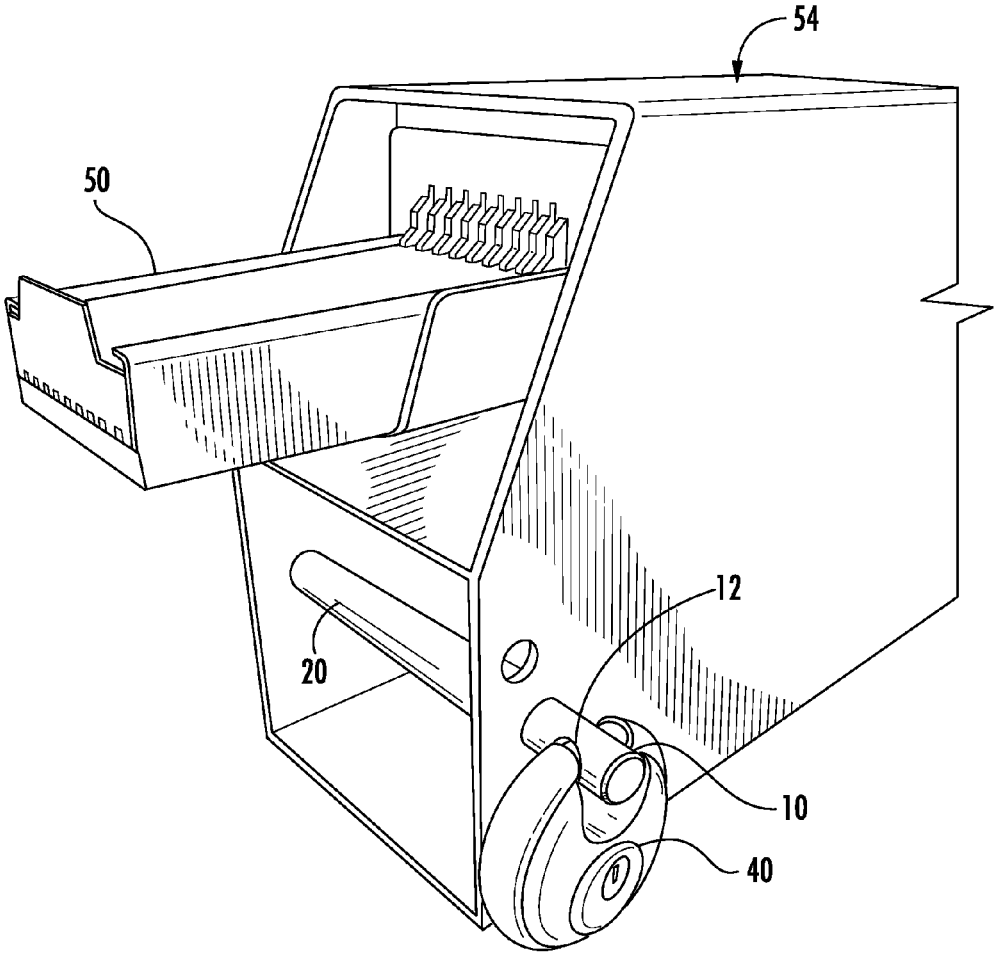
FIG. 2 illustrates a first side view of a first embodiment of the laundry coin anti-theft device.

Referring to FIG. 2, a first side view of an embodiment of the laundry coin anti-theft device 1 of the present invention is shown. The distal end 10 is shown more clearly, including lock penetration 12 and lock 40.

Figure 3:
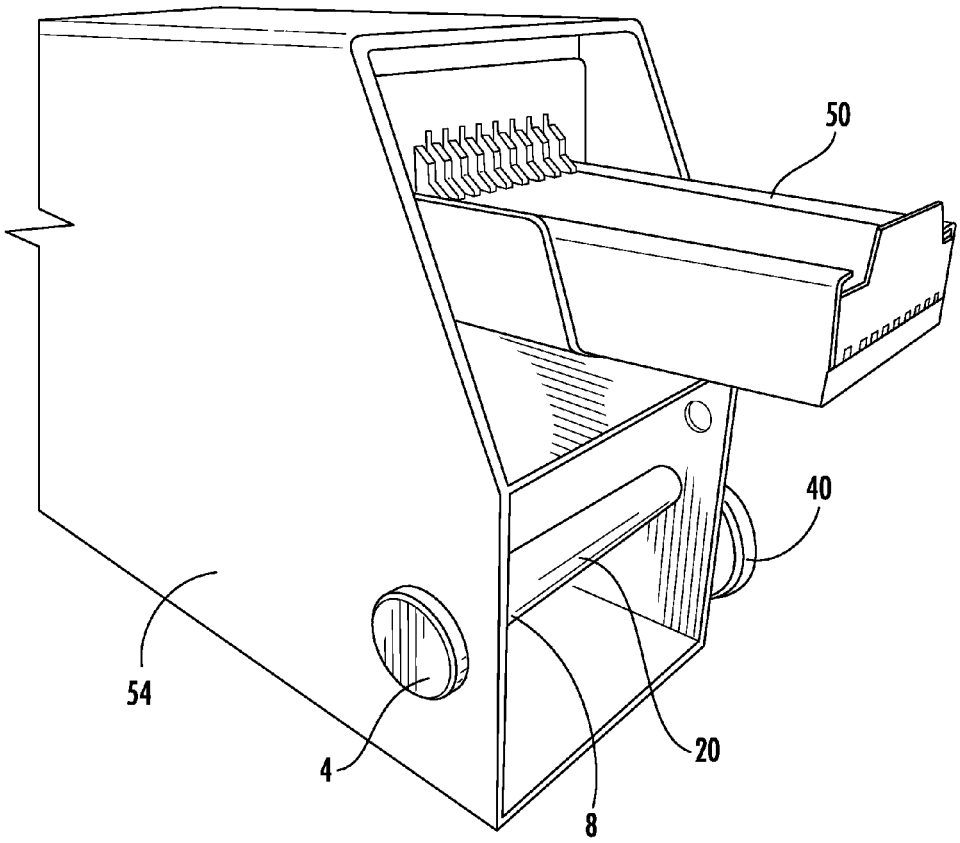
FIG. 3 illustrates a second side view of a first embodiment of the laundry coin anti-theft device.

Referring to FIG. 3, a second side view of an embodiment of the laundry coin anti-theft device 1 of the present invention is shown. The proximal end 8 is more clearly shown, and the flat, round shape of the head 4 near the proximal end 8.

Figure 4:
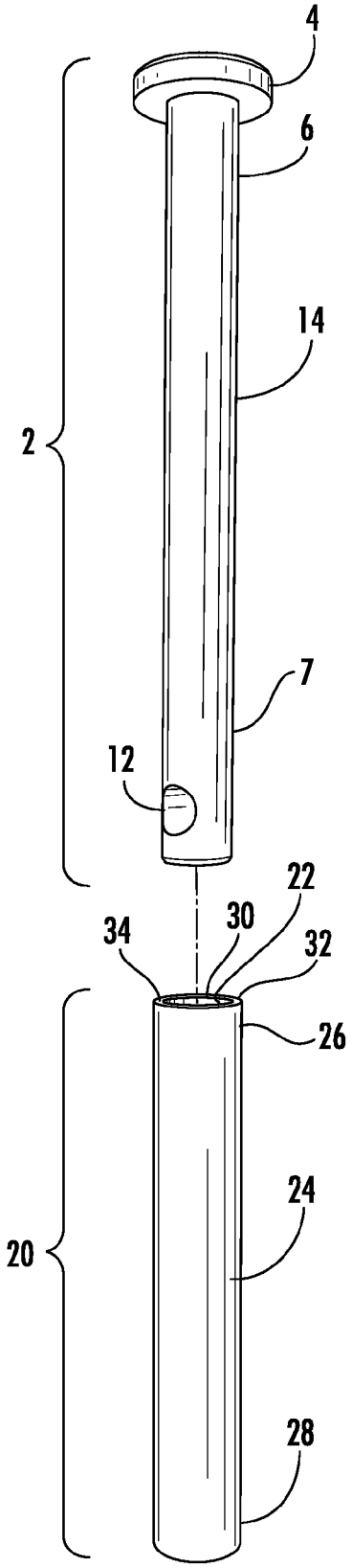
FIG. 4 illustrates a detailed view of a first embodiment of the laundry coin anti-theft device.

Referring to FIG. 4, an embodiment of the laundry coin anti-theft device 1 of the present invention is shown. Outer diameter 14 of the pin 2, is shown.

Additional detail of the sleeve 20, including inner surface 22, outer surface 24, proximal end 26, distal end 28, inner diameter 30, outer diameter 32, and thickness 34 is shown.

The inner surface 22 and outer surface 24 are preferably smooth to make it difficult for a thief to grip the sleeve 20. A smooth inner surface 22 reduces friction between the pin 2 and sleeve 20. The inner diameter 30 of the sleeve 20 is larger than the outer diameter 14 of the pin 2, again to allow for ease in sliding.

The sleeve 20 is shown as circular, but many other shapes are permissible assuming that sliding motion is still permitted between the pin 2 and the sleeve 20.

The sleeve 20 does not need to form a complete tube, as would be formed by drawing metal through a die. The sleeve 20 may be formed by bending a metal plate to form a tube, which by virtue of its manufacturing would leave a gap, and may be of a less than perfect circular shape.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device for preventing the theft of a laundromat coin box, the device including a pin within a sleeve, the sleeve freely rotating around the pin when the device is installed, the pin with sleeve to be installed into a laundry coin mechanism, the device obstructing access to the laundry coin box and its associated laundry coin box lock by shielding the laundry coin box lock from impact, the pin including a lock penetration.

2. The device for preventing the theft of a laundromat coin box of claim 1, wherein the pin comprises a head and a rod portion, the rod portion of a substantially circular cross-section, the head of a substantially circular cross-section and of a greater diameter than the rod portion.

3. The device for preventing the theft of a laundromat coin box of claim 2, wherein the sleeve is a hollow tube of substantially round cross-section that substantially encloses the rod portion of the pin.

4. The device for preventing the theft of a laundromat coin box of claim 3, wherein the free rotation of the sleeve around the pin makes gripping the pin difficult in the absence of sufficient force to crush the sleeve against the rod portion of the pin.

5. The device for preventing the theft of a laundromat coin box of claim 4, the lock penetration located distal from the head of the pin, and a lock, the lock and head of the pin acting to brace a left wall and a right wall separated by a space occupied by the laundromat coin box, the device preventing the walls from being spread apart to allow a thief to access the coin box.

6. The device for preventing the theft of a laundromat coin box of claim 4, wherein the head includes a chamfered edge to make gripping the head more difficult.

7. The device for preventing the theft of a laundromat coin box of claim 4, wherein the head includes a rounded edge to make gripping the head more difficult.

8. The device for preventing the theft of a laundromat coin box of claim 3, wherein the lock penetration is located distal from the head of the pin, the lock penetration adapted to accept a lock.

9. A laundry coin box anti-theft device for use as part of a laundry coin mechanism housing, the laundry coin mechanism housing having two penetrations, the penetrations located within walls to either side of a laundry coin box, the laundry coin box anti-theft device comprising:

a. a pin, the pin having a first cross-sectional shape, the first cross-sectional shape forming a rod, the pin having a proximal end, a distal end, and an outer diameter, the pin having a head at the proximal end, and a penetration at the distal end;

b. a sleeve, the sleeve substantially enclosing the pin with the exception of the head, an inner diameter of the sleeve being larger that the outer diameter of the pin, the sleeve having a second cross-sectional shape; and c. wherein the pin is installed by insertion through the two penetrations of the coin box mechanism, the sleeve entirely contained between the two penetrations and the walls to either side of the laundry coin box.

10. The laundry coin box anti-theft device of claim 9, wherein the penetration of the pin is adapted for use with a lock.

11. The laundry coin box anti-theft device of claim 10, further comprising a lock.

12. The laundry coin box anti-theft device of claim 9, the laundry coin box anti-theft device installed horizontally in-line with a lock of the laundry coin box, the laundry coin box anti-theft device physically blocking access to the lock.

13. The device for preventing the theft of a laundromat coin box of claim 12, wherein the head includes a chamfered edge to make gripping the head more difficult.

14. The device for preventing the theft of a laundromat coin box of claim 12, wherein the head includes a rounded edge to make gripping the head more difficult.

15. A laundry coin box anti-theft device for use with a laundry coin mechanism housing, the laundry coin box mechanism including a coin slide and a coin box, the coin box including a coin box lock, the laundry coin mechanism housing further including two penetrations located to either side of the coin box, horizontally in line with the coin box lock, the laundry coin box anti-theft device comprising:

a. a pin, the pin having a substantially circular cross-section forming a rod, the pin having a proximal end, a distal end, and an outer diameter, the pin having a head at the proximal end, the head having a substantially circular cross-section without the perimeter of the cross-section including flat surfaces, the head further including a chamfered edge, and the pin including a penetration at the distal end;

b. a sleeve, the sleeve substantially enclosing the pin with the exception of the head, an inner diameter of the sleeve being larger that the outer diameter of the pin, the sleeve having a substantially circular cross-section, the sleeve adapted to free rotate around the pin after installation of the laundry coin box anti-theft device; and c. wherein the pin is installed by insertion through the two penetrations of the laundry coin mechanism, the sleeve contained between the two penetrations.

* * * * *